US011397444B2

(12) United States Patent
Manohar et al.

(10) Patent No.: US 11,397,444 B2
(45) Date of Patent: Jul. 26, 2022

(54) VOLTAGE REGULATOR DROPOUT DETECTION

(71) Applicant: Apple Inc., Cupertino, CA (US)

(72) Inventors: Sujan K. Manohar, Austin, TX (US); Jay B. Fletcher, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 51 days.

(21) Appl. No.: 16/953,257

(22) Filed: Nov. 19, 2020

(65) Prior Publication Data

US 2022/0155808 A1 May 19, 2022

(51) Int. Cl.
*G05F 1/56* (2006.01)
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ..... G05F 1/565; G05F 1/575
See application file for complete search history.

(56) References Cited

U.S. PATENT DOCUMENTS 7,495,506 B1 * 2/2009 Carper ..... G05F 1/575 327/540
8,593,833 B2 11/2013 Yang et al.
9,041,365 B2 5/2015 Kay et al.
9,692,298 B2 6/2017 Pregitzer et al.
9,755,519 B1 9/2017 Huang
2010/0289475 A1 * 11/2010 Lipka ..... G05F 1/575 323/315
2013/0076323 A1 * 3/2013 Huang ..... G05F 1/46 323/280
2013/0119954 A1 * 5/2013 Lo ..... G05F 1/575 323/280
2015/0061622 A1 * 3/2015 Bhattad ..... G05F 1/56 323/280
2017/0322573 A1 11/2017 Bhattad et al.
2021/0389790 A1 * 12/2021 Raducan ..... G05F 1/569

OTHER PUBLICATIONS

First Examination Report in IN Appl. 202114049444 dated May 30, 2022, 6 pages.

* cited by examiner

*Primary Examiner* — Kyle J Moody
*Assistant Examiner* — Lakaisha Jackson
(74) *Attorney, Agent, or Firm* — Kowert, Hood, Munyon, Rankin & Goetzel, P.C.; Erik A. Heter; Dean M. Munyon

(57) ABSTRACT

A dropout detection circuit for an LDO voltage regulator is disclosed. An LDO voltage regulator includes a power transistor having a drain terminal coupled to an output voltage node and a gate terminal coupled to an output of an error amplifier. A source terminal of the power transistor is coupled to an input voltage node. The circuit further includes a detection circuit having a first input coupled to the gate terminal and a second input coupled to the drain terminal. The detection circuit is configured to generate an indication responsive to detecting that the LDO voltage regulator has entered operation below a minimum dropout.

20 Claims, 8 Drawing Sheets

- M31 is Matched to Power Transistor M1 in one or more device characteristics (e.g., similar W/L ratio, although scaled in Size with Lower Current Density
- M33 and M34 are Matched In Device Characteristics In the Illustrated Embodiment

- M43 and M44 have Matched Device Characteristics and have a Transconductance that is Proportional to 1/R41
- M46 is Matched in Device Characteristics to M45, and Mirrors the Output Current of the Circuit to the Comparator
- R41 and R42 are Matched in Resistance and can be Scaled Accordingly to Adjust the Threshold of the Output Comparator

VOLTAGE REGULATOR DROPOUT DETECTION

BACKGROUND

Technical Field

This disclosure is directed to voltage regulator circuits, and more particularly, to circuits for detecting and controlling parameters of voltage regulator circuits.

Description of the Related Art

Low dropout (LDO) voltage regulators are widely used in electronic systems. Such systems may include portable devices (e.g., smartphones, tablet computers), wherein the input voltage source for an LDO voltage regulator is a battery. And LDO voltage regulator may provide various advantages over switching voltage regulators. These advantages include the absence of switching noise, smaller size (e.g., due to the lack of inductors), and relative simplicity.

An LDO voltage regulator is a linear regulator the receives a DC input voltage and provides a regulated DC output voltage. LDO regulators typically include a reference voltage source, an error amplifier, and a power transistor. The regulated output voltage provided by an LDO voltage regulator is typically less than the input voltage by at least some amount. This amount may be referred to as the dropout voltage, which is an amount of voltage an LDO voltage regulator needs to receive above its rated output voltage in order to be able to regulate the output voltage. This amount may further be defined by the operating region of the power transistor. When the power transistor is operating in the saturation region, the LDO regulator may be considered to be above a minimum dropout. When the power transistor enters the linear/ohmic region, the LDO voltage regulator may be considered to be operating below a minimum dropout.

SUMMARY

A dropout detection circuit for an LDO voltage regulator is disclosed. In one embodiment, an LDO voltage regulator includes a power transistor having a drain terminal coupled to an output voltage node and a gate terminal coupled to an output of an error amplifier. A source terminal of the power transistor is coupled to an input voltage node. The circuit further includes a detection circuit having a first input coupled to the gate terminal and a second input coupled to the drain terminal. The detection circuit is configured to generate an indication responsive to detecting that the LDO voltage regulator has entered operation below a minimum dropout.

In one embodiment, the detection circuit is coupled to a power management circuit. Responsive to assertion of the indication by the detection circuit, the power management circuit may begin a power down procedure to power down a functional circuit block that is coupled to receive a regulated supply voltage from the voltage regulator.

BRIEF DESCRIPTION OF THE DRAWINGS

The following detailed description makes reference to the accompanying drawings, which are now briefly described.

DETAILED DESCRIPTION OF EMBODIMENTS

Figure 1:
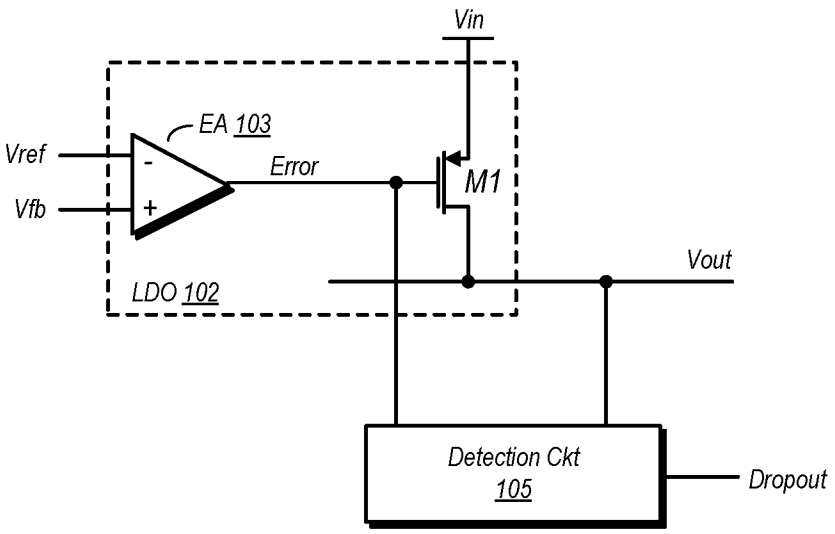
FIG. 1 is a diagram of one embodiment of a voltage regulator coupled to a detection circuit.

LDO voltage regulators are widely used in electronic systems, including portable systems. In some systems (e.g., portable systems such as smartphones), the input voltage source for an LDO voltage regulator is a battery. A voltage across a power transistor of the LDO voltage regulator (between the input voltage and the output voltage) is referred to as a dropout voltage, or more simply, dropout. When the LDO voltage regulator is operating above its minimum dropout, the power transistor may be operating in the saturation region. As the battery voltage declines, the power transistor of the LDO voltage regulator enters the ohmic/linear region. When this condition occurs, the LDO voltage regulator is said to be operating below a minimum dropout. Since the threshold voltage of the power transistor can change with operating conditions (e.g., temperature), the dropout voltage may have some variability. Nevertheless, once the power transistor begins persistent operation in the linear/ohmic region, it may be considered to be operating below the minimum dropout.

When the power transistor is operating in the linear region, the LDO regulator begins to lose its ability to regulate its output voltage. The LDO voltage regulator may be said to be operating below the minimum dropout when the power transistor is operating in the linear region, the minimum dropout being a dropout value above which the output voltage may be regulated. Thus, when operating below the minimum dropout, gain will fall and the output voltage may eventually collapse. This can lead to a sudden shutdown of the circuits relying on the LDO voltage regulator for power. Shutdowns of this type are generally undesirable for various reasons, such as the potential loss of internal states of the various affected circuits and extra stress on the various devices that make up these circuits.

The present disclosure utilizes the insight that, if the power transistor is entering the linear/ohmic region, and thus the LDO voltage regulator is falling below a minimum dropout, an indication can be generated and provided to, e.g., a power management circuit. The power management circuit can then begin an orderly shutdown of the circuits that receive a regulated supply voltage from the LDO voltage regulator.

Accordingly, the present disclosure implements an LDO dropout detection circuit that detects when a correspondingly coupled LDO voltage regulator is entering a region of operation below the minimum dropout. In one embodiment, the detection circuit generates first and second currents. The first current may be generated based on a difference between gate and drain voltages of the power transistor. A second current may be generated based on a threshold voltage of the power transistor. A comparator may compare these two currents, and based on the results, determine whether the LDO voltage regulator is beginning operation below the minimum dropout. If this dropout condition is detected, the indication is generated. The indication may then be used to trigger, e.g., a power management circuit to being a shutdown procedure to provide orderly powering down of the circuits acting as a load for the LDO voltage regulator.

An orderly shutdown can, for example, include suspending operation at a particular point and saving an internal state of the circuits. This may allow the circuit to resume operation at that point upon power being returned thereto. Additionally, the ability to power down circuits in this manner (as opposed to a sudden power down when the LDO voltage regulator loses the ability to regulate the output voltage) may reduce the stress on the affected circuits, thereby enhancing their operating life and improve their long-term reliability. Another potential advantage is the prevention of dynamic leakage currents and failures that can affect cross-domain (voltage domain) level shifters.

Within the disclosure, references may be made to a voltage regulator entering operation below a minimum dropout. References may also be made to a power transistor of an LDO voltage regulator entering the linear region or entering the ohmic region. These terms may be used interchangeably. In particular, the LDO voltage regulator in the disclosure may be considered to be operating below the minimum dropout whenever the power transistor is operating in the region that can be referred to as either the linear region or the ohmic region.

The discussion that follows includes an overview and schematic example of one embodiment of a detection as coupled to an example LDO voltage regulator. Thereafter, a discussion of circuitry internal to an embodiment of the detection circuit is provided. An example integrated circuit is then discussed, followed by flow diagrams illustrating operation of various embodiments of a detection circuit. An example system diagram is then discussed.

Detection Circuit for LDO Voltage Regulator:

FIG. 1 is a diagram of one embodiment of a voltage regulator coupled to a detection circuit. In the embodiment shown, an LDO voltage regulator 102 includes an error amplifier 103 that is coupled to receive a reference voltage on a first input and a feedback voltage on a second input. The reference voltage, Vref, may be generated by a bandgap circuit or other circuit capable of generating a persistent voltage. The feedback voltage Vfb may be generated based on the output voltage, Vout, the latter being the regulated supply voltage produced by LDO voltage regulator 102. Based on a difference between the reference voltage and the feedback voltage, error amplifier 103 may generate on its output an error signal.

LDO voltage regulator 102 in the embodiment shown includes a power transistor M1, which is a PMOS transistor in this particular embodiment. The source terminal of M1 is coupled to receive an input voltage, Vin. The gate terminal of M1 is coupled to receive the error signal, while the drain terminal is coupled to the output node, Vout, from which the regulated supply voltage generated by LDO voltage regulator is provided. It is noted that the configuration of LDO voltage regulator 102 is shown here by way of example, but is not intended to be limiting. On the contrary, a wide variety of LDO voltage regulators in varying configurations may be implemented in accordance with this disclosure.

The source of Vin in one embodiment may be a battery, although the disclosure is not limited to this type of voltage source. In embodiments in which Vin is produced by a battery, the battery may be rechargeable. Between charges, the voltage produced by the battery, and thus Vin, may drop over time. As the battery voltage falls, it may reach a point where transistor M1 discontinues operation in the saturation region and enters the ohmic, or linear region of operation. This can also be referred to as voltage regulator 102 falling below the minimum dropout. When this condition occurs, LDO voltage regulator 102 may lose its ability to regulate its output voltage. This can cause undesired effects, including malfunction of various circuitry in a load circuit configured to receive the regulated supply voltage from LDO voltage regulator 102, as well as a sudden shutdown.

To determine when LDO voltage regulator 102 have fallen below the minimum dropout, detection circuit 105 is provided. In this particular embodiment, detection circuit 105 includes two inputs, a first of which is coupled to the output voltage node ('Vout') and a second of which is coupled to the gate terminal of power transistor M1. Based on these inputs, detection circuit 105 may determine whether transistor M1 has begun operation in the linear region and thus LDO voltage regulator 102 is below the minimum dropout.

When this occurs, detection circuit 105 may assert an indication, labeled here as 'Dropout'. This indication may be received by other circuitry, such as a power management circuit, which may then take appropriate action. For example, an appropriate action by the power management circuit could include the beginning a power down procedure in which critical data is saved, an internal state of various circuits is saved, and more generally, a procedure in which the circuits are powered down in an orderly manner as opposed to a sudden, unexpected shutdown.

Figure 2:
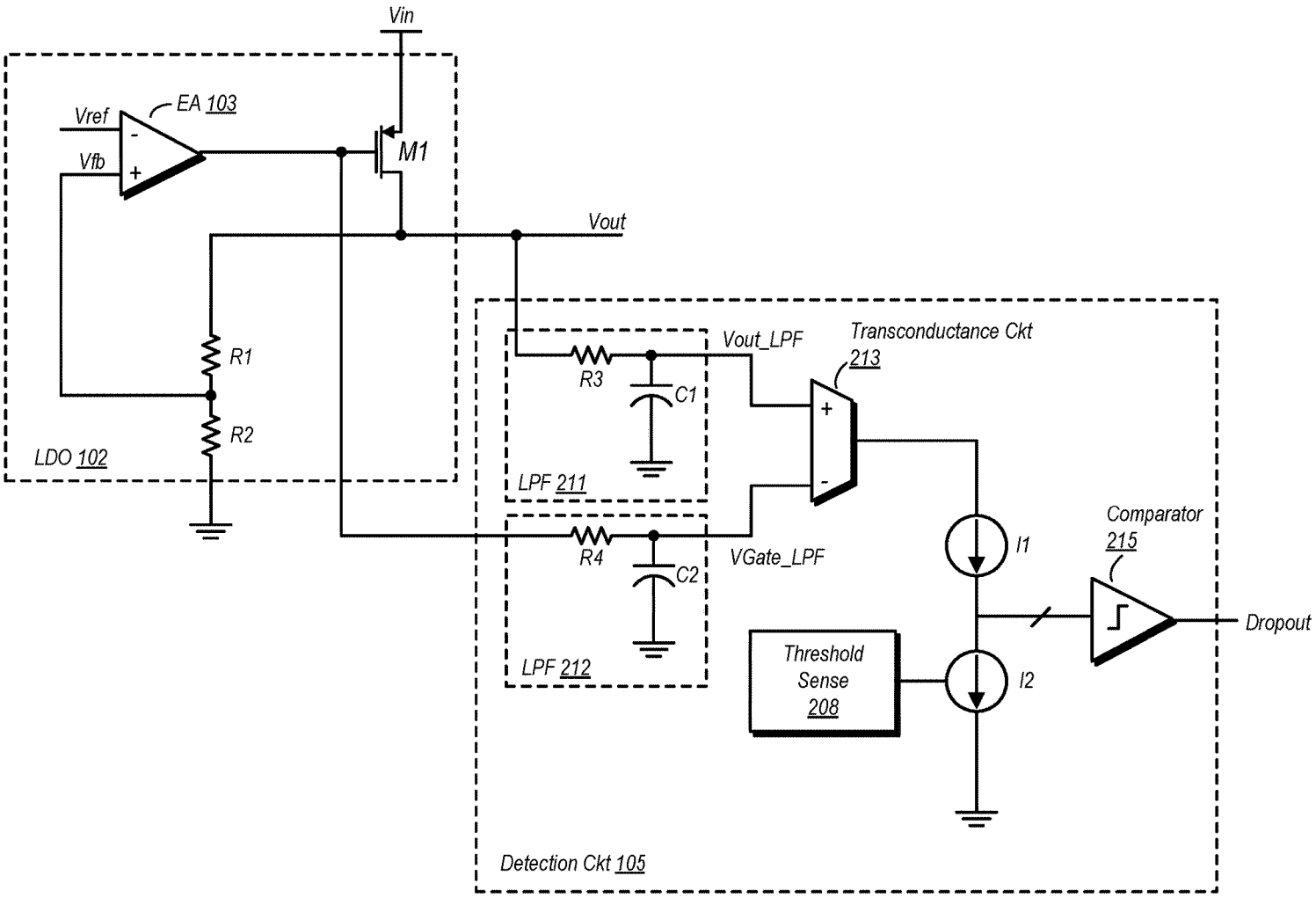
FIG. 2 is a schematic diagram illustrating details of one embodiment of a detection circuit coupled to a voltage regulator.

FIG. 2 illustrates further details of one embodiment of one embodiment of both an LDO voltage regulator and a detection circuit. In the embodiment shown, LDO voltage regulator 102 is configured similarly to that of FIG. 1, with additional details regarding the generation of the feedback voltage being provided. In this particular example, the output voltage node is coupled to a voltage divider circuit that includes resistors R1 and R2. The feedback voltage is generated at the junction of R1 and R2, and provide to the corresponding input of error amplifier 103.

Detection circuit 105 in the embodiment shown includes a pair of low-pass filters 211 and 212, a transconductance circuit 213, a threshold sense circuit 208, and a comparator 215. Transconductance circuit 213 in the embodiment shown is arranged to generate a first current, I1, while threshold sense circuit 208 is configured to generate a second current, I2 (details of embodiments threshold sense circuit 208 and transconductance circuit 213 are discussed below). The two currents, I1 and I2, are provided to comparator 215, where their respective values can be compared to one another to determine if transistor M1 has entered operation in the linear region, and thus LDO voltage regulator 102 is operating below its minimum dropout. If it is determined that LDO voltage regulator 102 is operating below a minimum dropout, comparator 215 in the embodiment shown asserts the 'Dropout' indication.

Low-pass filter 211 in the embodiment shown is coupled between the output node ('Vout') of LDO voltage regulator 102 and an input of transconductance circuit 213. Low-pass filter 211 includes resistor R3 and capacitor C1, and is may filter out transients in the output voltage, such as temporary drops due to rapid increases in current demand by a load circuit. Thus, the output of low-pass filter 211, Vout_LPF, may be a relatively stable output voltage that is input into transconductance circuit 213. Low-pass filter 212 in the embodiment shown is similarly arranged, having an input coupled to the gate terminal of the power transistor M1. Transients in the error signal produced by error amplifier 103 may be filtered out by low-pass filter 212, which may thus provide a relatively stable voltage VGate_LPF that is input into transconductance circuit 213. Using the two input voltages, Vout_LPF and VGate_LPF, transconductance circuit 213 may generate the first current I1 that is used in determining whether LDO voltage regulator 102 is operating below the minimum dropout.

Threshold sense circuit 208 in the embodiment shown is configured to generate the second current, I2. This current may be generated based on a threshold voltage of transistor M1. As will be explained in further detail below, threshold sense circuit 208 may include at least one transistor implemented with device characteristics intended to match those of power transistor M1. Accordingly, the transistor may have threshold voltage that corresponds to that of M1. Thus, variations in this threshold voltage, if any, may be reflected in the second current I2.

Comparator 215 in the embodiment shown is coupled to receive the two current and compare their respective values to one another. In this embodiment, comparator 215 is a Schmitt trigger, and thus there is an inherent hysteresis in its operation. This hysteresis may further aid in filtering out and transient conditions that could otherwise cause the assertion of the Dropout indication for what is a temporary condition. It is noted however that the function implemented by comparator 215 is not limited to a Schmitt trigger per this disclosure. Any suitable mechanism for detecting that LDO voltage regulator 102 is below the minimum dropout may be used, and this may include any suitable mechanism for implementing hysteresis.

Figure 3:
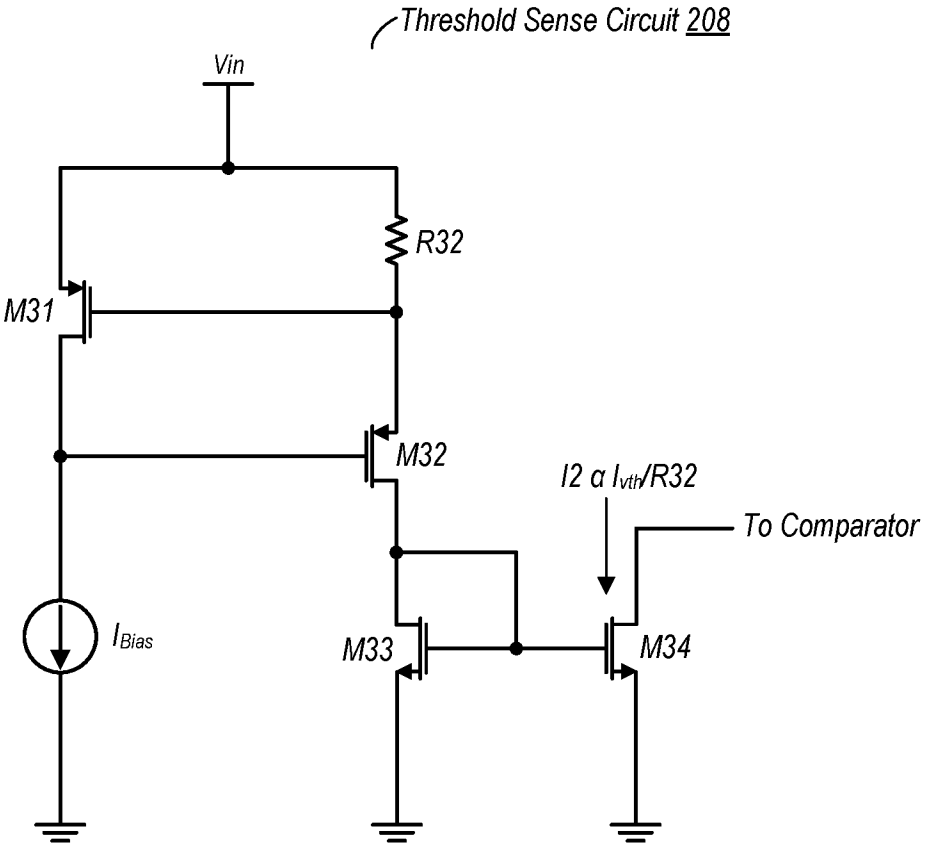
FIG. 3 is a schematic diagram of one embodiment of a threshold sense circuit.

Threshold Sense and Transconductance Circuit Examples:

FIG. 3 illustrates one embodiment of a threshold sense circuit 208 that may be implemented in an embodiment of detection circuit 105. In the embodiment shown, threshold sense circuit includes a transistor M31, referred to here as a replica transistor. More particular, M31 may have one or more device characteristics in common with power transistor M1 of LDO voltage regulator 102. For example, a width and length of a channel in M31 may be sized such that the width/length ratio is matched as closely as possible to that of M1. Other device characteristics may be matched as well. Accordingly, M31 is implemented such that there is a correspondence between its threshold voltage and that of M1. Moreover, if the threshold voltage of M1 varies due to operating conditions, the threshold voltage of M31 may vary correspondingly.

In the embodiment shown, threshold sense circuit 208 is coupled to receive the same input voltage, Vin, that is received by LDO voltage regulator 102. The input voltage is receive on a source terminal of M31, and is also receive on a terminal of resistor R32. The other terminal is coupled to the gate terminal of M31, and thus R32 contributes to setting the gate voltage of that device. The drain terminal of M31 is coupled to a bias current source, $I_{Bias}$. A gain transistor, M32, includes a source terminal coupled to the gate of M32, and a gate terminal coupled to the drain of M31. Gain transistor M32 in the embodiment shown, provides gain to the gate-drain voltage of M31.

Threshold sense circuit 208 includes a current mirror coupled to gain transistor M32. More particularly, the drain terminal of M32 is coupled to the drain and gate terminals of diode-coupled transistor M33. A second transistor M34 completes the current mirror. In one embodiment, transistors M33 and M34 are matched transistors, having substantially the same device characteristics. The output current, I2, is mirrored by transistor M33 through transistor M34. This output current is proportional to a ratio of a current $I_{vth}$ to the resistance of R32. As previously noted, the current I2 corresponds to the threshold voltage of the power transistor in LDO voltage regulator 102.

Figure 4:
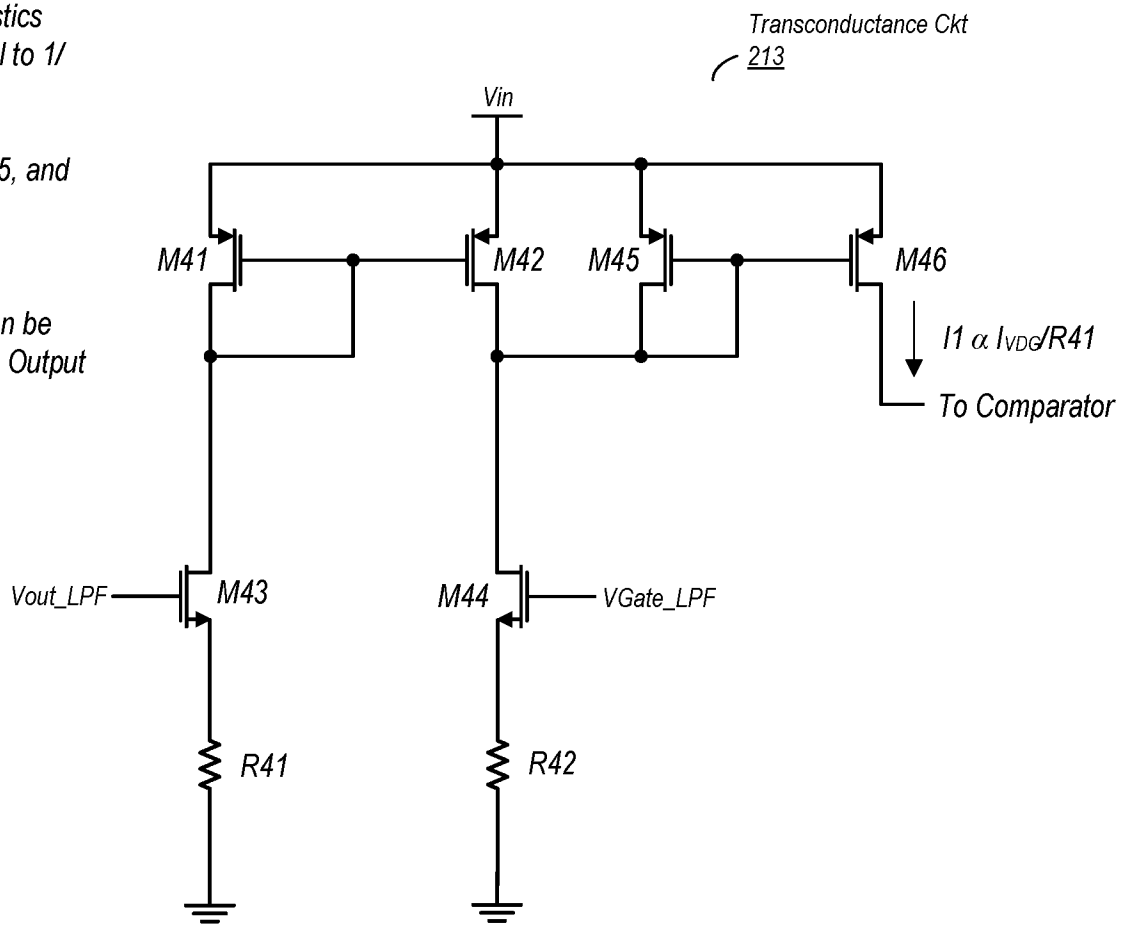
FIG. 4 is a schematic diagram of one embodiment of a transconductance circuit.

FIG. 4 is a schematic diagram of one embodiment of a transconductance circuit used to generate a current corresponding to a gate-drain voltage of the power transistor in an LDO voltage regulator. In the embodiment shown, transconductance circuit 213 is coupled to receive the input voltage Vin, and is thus sensitive to changes in this voltage as is the LDO voltage regulator 102. Transconductance circuit 213 includes a first current mirror including transistors M41 and M42, with M41 being a diode-coupled device. Transconductance circuit 213 further includes a pair of input transistors, M43 and M44. Transistors M43 and M44 include corresponding gate terminals coupled to receive input voltages Vout_LPF and VGate_LPF, respectively (as discussed above in reference to FIG. 2). Each of M43 and M44 are NMOS devices in the embodiment shown, with their source terminals coupled to R41 and R42, respectively. In this embodiment, transistors M43 and M44 have substantially matched device characteristics, with. Furthermore, resistors R41 and R42 have substantially matched resistances. The transconductance of transistors M43 and M44 in this embodiment is approximately 1/R41 (or 1/R42, assuming R41 and R42 are matched resistances). The two resistors may be scaled in order to adjust the threshold of the output comparator.

The first current mirror in the illustrated embodiment, comprising transistors M41 and M42, is configured to generate a current based on the difference between the filtered gate and drain voltages of the power transistor M1 of LDO voltage regulator 102 (where the drain voltage is the output voltage of the regulator). The first current mirror is coupled to a second current mirror that includes transistors M45 and M46, with the former being the diode-coupled device. Furthermore, the drain terminal of M45 is coupled to the drain terminal of M42 from the first current mirror. Accordingly, the current through the second current mirror is dependent upon the current through the first current mirror.

Transistors M45 and M46 in the embodiment shown have substantially matching device characteristics. In the current mirror formed by these devices, the current through M45 is mirrored to M46, and thus to the comparator. The current I1 that is received by the comparators is proportional to the ratio $I_{VDG}$/R41, where $I_{VDG}$ corresponds to the gate-drain current of the power transistor in LDO voltage regulator 102.

It is noted that the circuits of FIGS. 3 and 4 are shown here by way of example, but are not intended to be limiting. Accordingly, the disclosure contemplates that other types of circuits may be used to generate the currents I1 and I2. It is further noted that these currents may be used for other purpose (e.g., telemetry) in addition to those discussed here.

Figure 5:
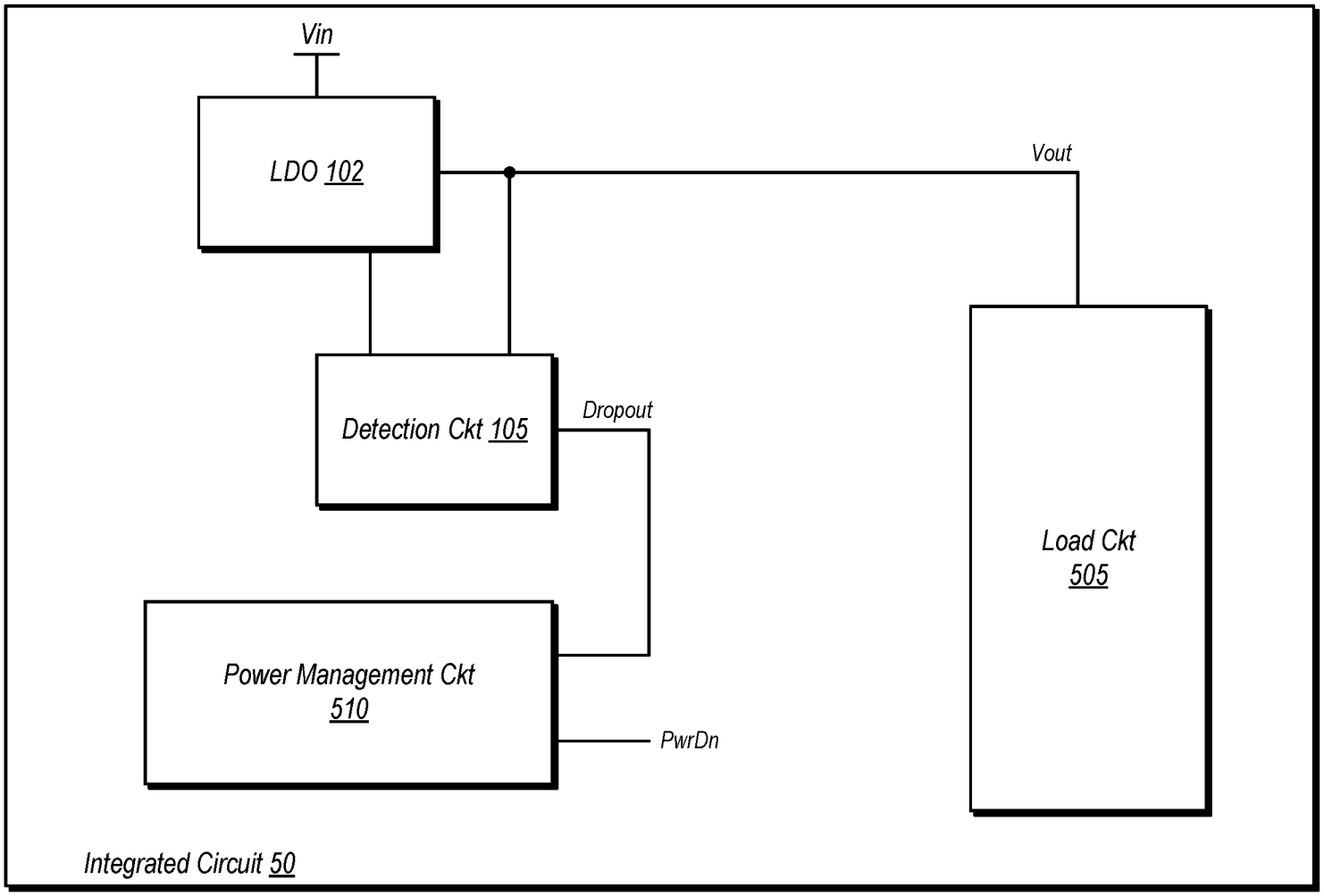
FIG. 5 is a block diagram of one embodiment of an integrated circuit.

Example Integrated Circuit:

FIG. 5 is a block diagram of one embodiment of an integrated circuit which includes embodiments of an LDO voltage regulator 102 and a detection circuit 105. LDO voltage regulator 102 and detection circuit 105 may be implemented using any variation of the embodiments discussed above. More generally, LDO voltage regulator 102 may be virtually any type of LDO voltage regulator, while detection circuit 105 may be virtually any type of circuit capable detecting when a power transistor of LDO voltage regulator 102 has entered operation in the linear/ohmic region. Thus, these circuits extend to various embodiments that are not explicitly discussed herein but are nevertheless covered by this disclosure.

Integrated circuit 50 in the embodiment shown includes at least one load circuit 505 that is coupled to receive a regulated supply voltage from LDO voltage regulator 102. Load circuit 505 may be virtually any type of circuitry, including analog, digital, and/or mixed signal circuitry. Example embodiments of load circuit 505 includes a processor core or portions thereof, interface circuitry, communications circuitry (e.g., for RF transmission or reception), and so on.

Detection circuit 105 in the embodiment shown is coupled to a power management circuit 510. Power management circuit 510 may carry out a number of different functions, including performance state changes (e.g., changing and operating voltage and/or clock frequency), workload balancing, and power management of idle circuits, among others. Additionally, power management circuit 510 may perform a power down of load circuit 505 responsive to assertion of the Dropout signal by detection circuit 105. Upon receiving the asserted Dropout signal, power management circuit 510 may initiate various steps to power down load circuit 505. These steps may include, for applicable circuits, saving a state of internal registers, saving critical data, completing or terminating otherwise incomplete transactions, and so on. Thus, the powering down of load circuit 505 may be conducted in an orderly manner. Thereafter, power management circuit 510 may cause power to be removed from load circuit 505.

Figure 6:
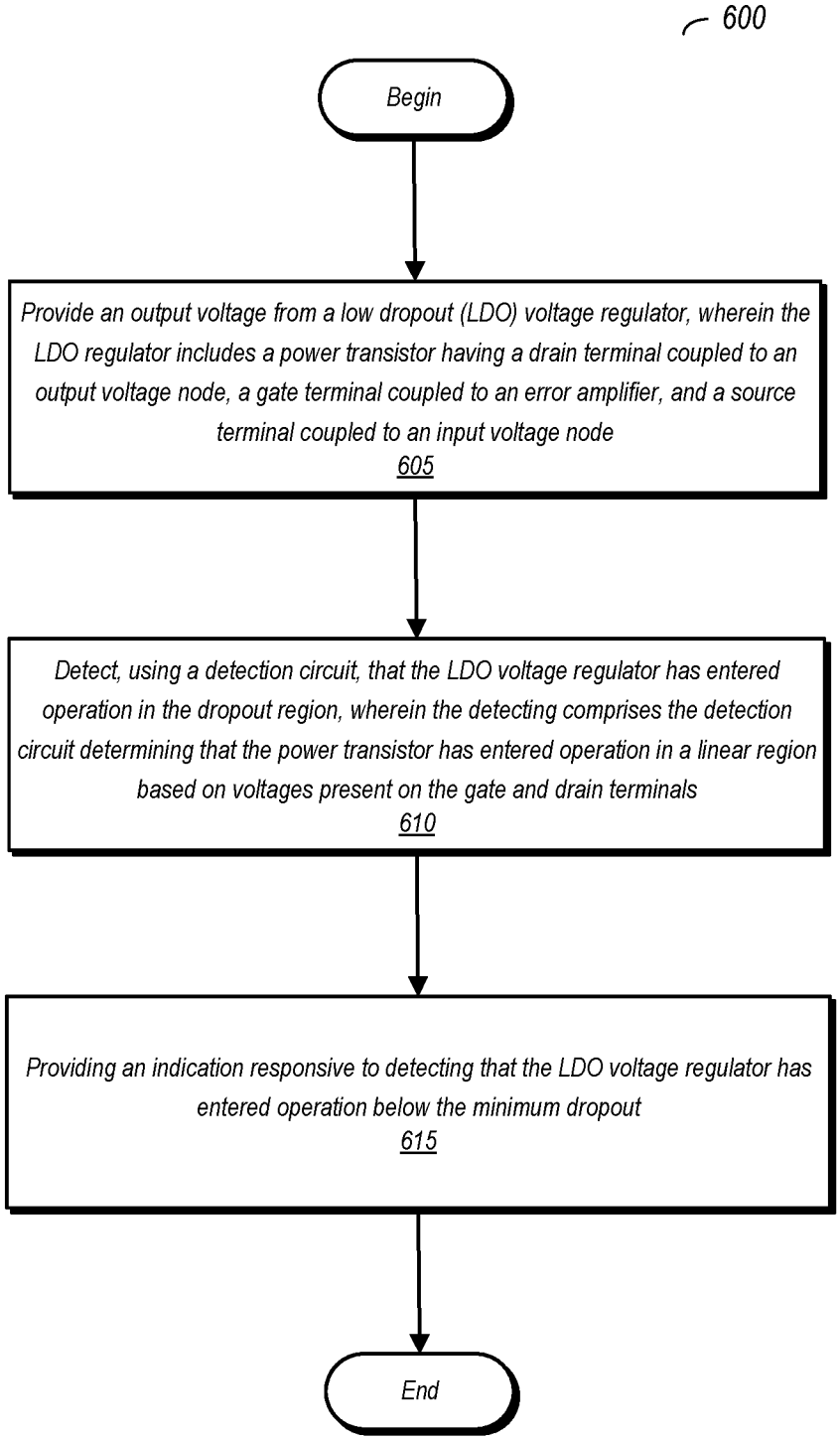
FIG. 6 is a flow diagram of one embodiment of a method for operating a detection circuit to detect an LDO voltage regulator entering a dropout condition.

Flow Diagrams:

FIG. 6 is a flow diagram of a method for operating a detection circuit to detect an LDO voltage regulator entering a dropout condition. Method 600 as discussed herein may be performed with any of the embodiments and variations thereof as discussed above with reference to FIGS. 1-5. Furthermore, circuit/apparatus embodiments not explicitly disclosed herein, but capable of carrying out Method 600, are considered to fall within the scope of this disclosure.

Method 600 includes providing an output voltage from a low dropout (LDO) voltage regulator, wherein the LDO regulator includes a power transistor having a drain terminal coupled to an output voltage node, a gate terminal coupled to an error amplifier, and a source terminal coupled to an input voltage node (block 605). The method further includes detecting, using a detection circuit, that the LDO voltage regulator has entered operation in the dropout region, wherein the detecting comprises the detection circuit determining that the power transistor has entered operation in a linear region based on voltages present on the gate and drain terminals (block 610). Thereafter, the method includes providing an indication responsive to detecting that the LDO voltage regulator has entered operation in the dropout region.

In one embodiment, detecting that the LDO voltage regulator has entered operation in the dropout region comprises generating a first current based on a difference between a voltage on the gate terminal and a voltage on the drain terminal and generating a second current based on a threshold voltage of the power transistor. Generating the first current comprises, in various embodiments, providing a low-pass filtered version of the voltage on the gate terminal to a first input of a transconductance circuit and providing a low-pass filtered version of the voltage on the drain terminal to a second input of the transconductance circuit. The generation of the first current in such an embodiment further comprises generating, using a first current mirror, a third current using the low-pass filtered versions of the voltages on the gate terminal and the drain terminal and generating the first current based on the third current.

Various embodiments of the method further includes generating the second current using a threshold sense circuit having a replica transistor, wherein the replica transistor has one or more device characteristics matched with corresponding characteristics of the power transistor. In such embodiments, generating the second current further comprises a gain transistor providing gain to a gate-drain voltage of the replica transistor and a current mirror generating the second current based on the gain provided to the gate-drain voltage of the replica transistor.

To determine if the LDO voltage regulator is in dropout, various embodiments of the method include comparing, using a comparator circuit, a value of the first current to a value of the second current. Such embodiments further include generating the indication responsive to determining that the value of the first current is greater than value of the second current.

Figure 7:
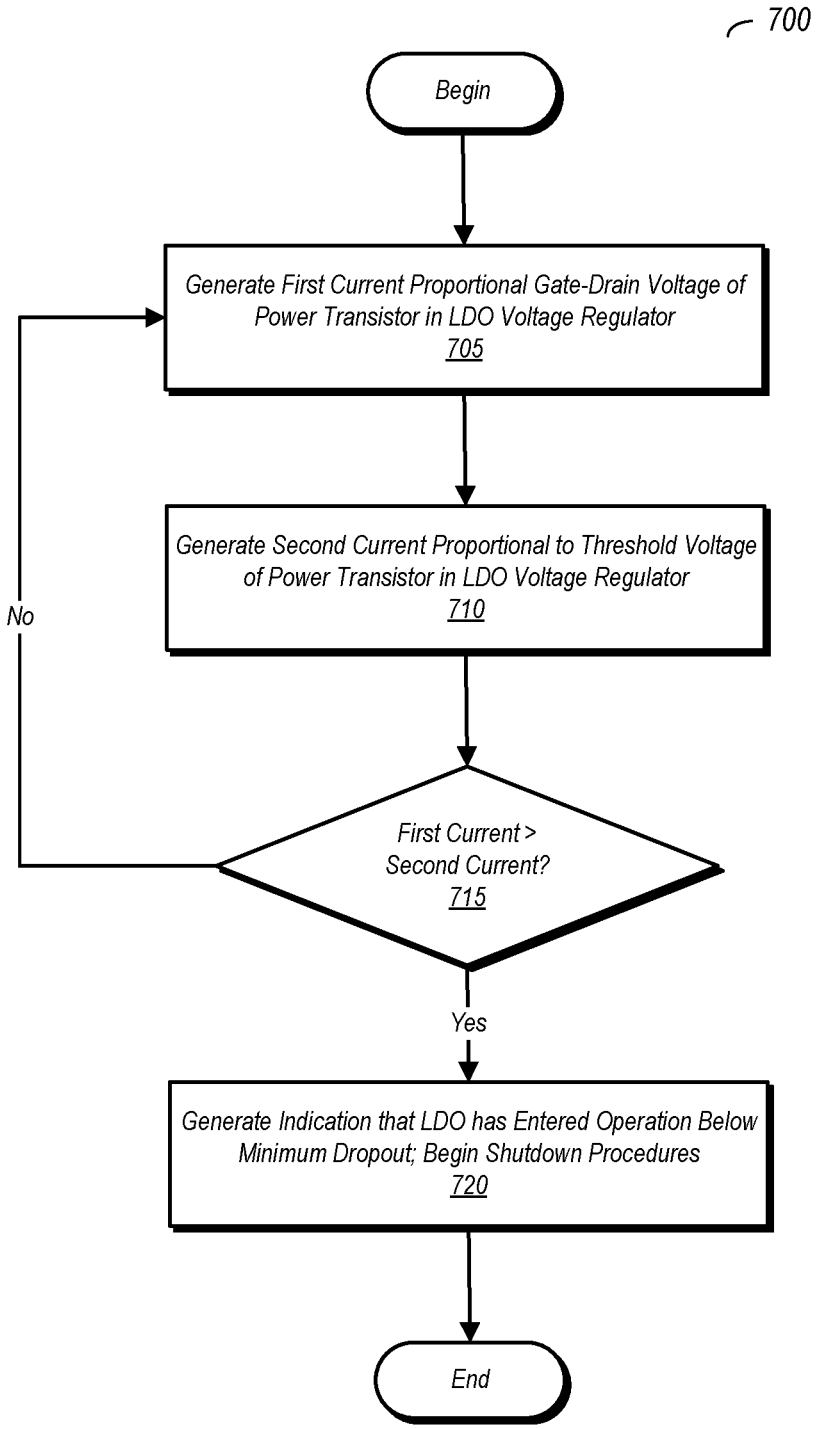
FIG. 7 is a flow diagram of another embodiment of a method for operating a detection circuit to detect an LDO voltage regulator entering a dropout condition.

FIG. 7 is a flow diagram of another embodiment of a method for operating a detection circuit used to detect the entry into dropout by an LDO voltage regulator. As with Method 600 discussed above, Method 700 may be performed by various embodiments of the circuits discussed above with reference to FIGS. 1-5. Additional circuit/apparatus embodiments capable of carrying out Method 700 may also be considered to fall within the scope of this disclosure.

Method 700 includes generating a first current that is proportional to a gate-drain voltage of a power transistor of an LDO voltage regulator (block 705). One example of a circuit capable of generating the first current per Method 700 is the transconductance circuit discussed above, although other embodiments capable of performing this function are possible and contemplated. The method further includes generating a second current proportional to a threshold voltage of the power transistor in the LDO voltage regulator (block 710). The second current may be generated by, e.g., a threshold sense circuit as previously discussed, but other circuit/apparatus embodiments capable of generating the second current are also possible and contemplated. The generated currents may be compared to one another.

If the value of the first current is greater than the value of the second current (block 720, yes), an indication is generated by, e.g., a comparator circuit, that the power transistor is in the linear/ohmic region and thus the LDO voltage regulator is in dropout, with a power management circuit or similar functional unit beginning shutdown procedures (block 720). The shutdown procedures may be used to prepare the affected circuits for shutdown, namely those load circuits that receive a regulated supply voltage from the LDO voltage regulator. This may include, for example, saving an internal state of the circuit (e.g., register contents), saving critical data, disabling a clock signal to the circuit to halt operation at a specific point, resolving unfinished transactions, and so on. Generally speaking, any function that may help ensure an orderly shutdown of the load circuits coupled to the LDO voltage regulator may be carried out. Thereafter, power may be removed from the affected circuits, and the LDO voltage regulator may be shut down as well.

If the value of the first current is less than that of the second current, operation may continue. Generation of the first and second currents may be performed on a continuous basis. Similarly, the comparison of the values of the first and second currents may also be performed on a continuous basis. The comparison operation may include some hysteresis in order to prevent a transient condition from causing a premature shutdown when the LDO voltage regulator is not otherwise in dropout.

Figure 8:
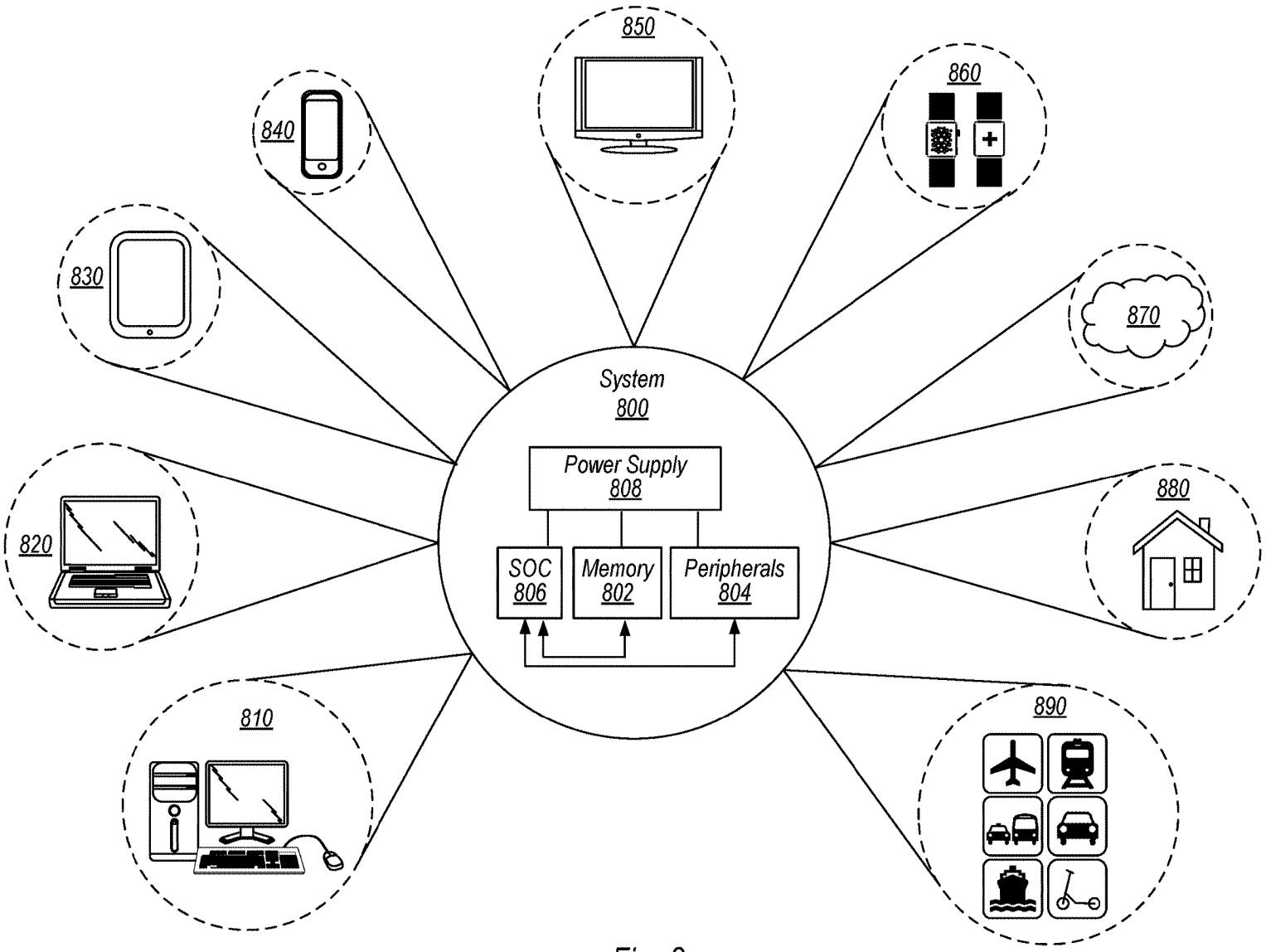
FIG. 8 is a block diagram of one embodiment of an example system.

Example System:

Turning next to FIG. 8, a block diagram of one embodiment of a system 800 is shown that may incorporate and/or otherwise utilize the methods and mechanisms described herein. In the illustrated embodiment, the system 800 includes at least one instance of a system on chip (SoC) 806 which may include multiple types of processing units, such as a central processing unit (CPU), a graphics processing unit (GPU), or otherwise, a communication fabric, and interfaces to memories and input/output devices. In various embodiments, SoC 806 is coupled to external memory 802, peripherals 804, and power supply 808.

A power supply 808 is also provided which supplies the supply voltages to SoC 806 as well as one or more supply voltages to the memory 802 and/or the peripherals 804. In various embodiments, power supply 808 represents a battery (e.g., a rechargeable battery in a smart phone, laptop or tablet computer, or other device). In some embodiments, more than one instance of SoC 806 is included (and more than one external memory 802 is included as well). In various embodiments, one or more LDO voltage regulators may be implemented on SoC 806, and may be implemented in additional locations of system 800 (e.g., on an integrated circuit within peripherals 804). Such LDO voltage regulators may be, at least in some instances, be paired with a detection circuit such as that discussed above in reference to FIGS. 1-7. As the battery voltage falls between charges, these detection circuits may detect when their respectively coupled LDO voltage regulators enter a dropout region and provide indications of the same. This information can then be used to perform an orderly shutdown of the affected circuits.

The memory 802 is any type of memory, such as dynamic random access memory (DRAM), synchronous DRAM (SDRAM), double data rate (DDR, DDR2, DDR3, etc.) SDRAM (including mobile versions of the SDRAMs such as mDDR3, etc., and/or low power versions of the SDRAMs such as LPDDR2, etc.), RAMBUS DRAM (RDRAM), static RAM (SRAM), etc. One or more memory devices are coupled onto a circuit board to form memory modules such as single inline memory modules (SIMMs), dual inline memory modules (DIMMs), etc. Alternatively, the devices are mounted with a SoC or an integrated circuit in a chip-on-chip configuration, a package-on-package configuration, or a multi-chip module configuration.

The peripherals 804 include any desired circuitry, depending on the type of system 800. For example, in one embodiment, peripherals 804 includes devices for various types of wireless communication, such as Wi-Fi, Bluetooth, cellular, global positioning system, etc. In some embodiments, the peripherals 804 also include additional storage, including RAM storage, solid state storage, or disk storage. The peripherals 804 include user interface devices such as a display screen, including touch display screens or multi-touch display screens, keyboard or other input devices, microphones, speakers, etc.

As illustrated, system 800 is shown to have application in a wide range of areas. For example, system 800 may be utilized as part of the chips, circuitry, components, etc., of a desktop computer 810, laptop computer 820, tablet computer 830, cellular or mobile phone 840, or television 850 (or set-top box coupled to a television). Also illustrated is a smartwatch and health monitoring device 860. In some embodiments, smartwatch may include a variety of general-purpose computing related functions. For example, smartwatch may provide access to email, cellphone service, a user calendar, and so on. In various embodiments, a health monitoring device may be a dedicated medical device or otherwise include dedicated health related functionality. For example, a health monitoring device may monitor a user's vital signs, track proximity of a user to other users for the purpose of epidemiological social distancing, contact tracing, provide communication to an emergency service in the event of a health crisis, and so on. In various embodiments, the above-mentioned smartwatch may or may not include some or any health monitoring related functions. Other wearable devices are contemplated as well, such as devices worn around the neck, devices that are implantable in the human body, glasses designed to provide an augmented and/or virtual reality experience, and so on.

System 800 may further be used as part of a cloud-based service(s) 870. For example, the previously mentioned devices, and/or other devices, may access computing resources in the cloud (i.e., remotely located hardware and/or software resources). Still further, system 800 may be utilized in one or more devices of a home other than those previously mentioned. For example, appliances within the home may monitor and detect conditions that warrant attention. For example, various devices within the home (e.g., a refrigerator, a cooling system, etc.) may monitor the status of the device and provide an alert to the homeowner (or, for example, a repair facility) should a particular event be detected. Alternatively, a thermostat may monitor the temperature in the home and may automate adjustments to a heating/cooling system based on a history of responses to various conditions by the homeowner. Also illustrated in FIG. 8 is the application of system 800 to various modes of transportation. For example, system 800 may be used in the control and/or entertainment systems of aircraft, trains, buses, cars for hire, private automobiles, waterborne vessels from private boats to cruise liners, scooters (for rent or owned), and so on. In various cases, system 800 may be used to provide automated guidance (e.g., self-driving vehicles), general systems control, and otherwise. These any many other embodiments are possible and are contemplated. It is noted that the devices and applications illustrated in FIG. 8 are illustrative only and are not intended to be limiting. Other devices are possible and are contemplated.

The present disclosure includes references to "embodiments," which are non-limiting implementations of the disclosed concepts. References to "an embodiment," "one embodiment," "a particular embodiment," "some embodiments," "various embodiments," and the like do not necessarily refer to the same embodiment. A large number of possible embodiments are contemplated, including specific embodiments described in detail, as well as modifications or alternatives that fall within the spirit or scope of the disclosure. Not all embodiments will necessarily manifest any or all of the potential advantages described herein.

Unless stated otherwise, the specific embodiments are not intended to limit the scope of claims that are drafted based on this disclosure to the disclosed forms, even where only a single example is described with respect to a particular feature. The disclosed embodiments are thus intended to be illustrative rather than restrictive, absent any statements to the contrary. The application is intended to cover such alternatives, modifications, and equivalents that would be apparent to a person skilled in the art having the benefit of this disclosure.

Particular features, structures, or characteristics may be combined in any suitable manner consistent with this disclosure. The disclosure is thus intended to include any feature or combination of features disclosed herein (either explicitly or implicitly), or any generalization thereof. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

For example, while the appended dependent claims are drafted such that each depends on a single other claim, additional dependencies are also contemplated, including the following: Claim 3 (could depend from any of claims 1-2); claim 4 (any preceding claim); claim 5 (claim 4), etc. Where appropriate, it is also contemplated that claims drafted in one statutory type (e.g., apparatus) suggest corresponding claims of another statutory type (e.g., method).

Because this disclosure is a legal document, various terms and phrases may be subject to administrative and judicial interpretation. Public notice is hereby given that the following paragraphs, as well as definitions provided throughout the disclosure, are to be used in determining how to interpret claims that are drafted based on this disclosure.

References to the singular forms such "a," "an," and "the" are intended to mean "one or more" unless the context clearly dictates otherwise. Reference to "an item" in a claim thus does not preclude additional instances of the item.

The word "may" is used herein in a permissive sense (i.e., having the potential to, being able to) and not in a mandatory sense (i.e., must).

The terms "comprising" and "including," and forms thereof, are open-ended and mean "including, but not limited to."

When the term "or" is used in this disclosure with respect to a list of options, it will generally be understood to be used in the inclusive sense unless the context provides otherwise. Thus, a recitation of "x or y" is equivalent to "x or y, or both," covering x but not y, y but not x, and both x and y. On the hand, a phrase such as "either x or y, but not both" makes clear that "or" is being used in the exclusive sense.

A recitation of "w, x, y, or z, or any combination thereof" or "at least one of . . . w, x, y, and z" is intended to cover all possibilities involving a single element up to the total number of elements in the set. For example, given the set [w, x, y, z], these phrasings cover any single element of the set (e.g., w but not x, y, or z), any two elements (e.g., w and x, but not y or z), any three elements (e.g., w, x, and y, but not z), and all four elements. The phrase "at least one of . . . w, x, y, and z" thus refers to at least one of element of the set [w, x, y, z], thereby covering all possible combinations in this list of options. This phrase is not to be interpreted to require that there is at least one instance of w, at least one instance of x, at least one instance of y, and at least one instance of z.

Various "labels" may proceed nouns in this disclosure. Unless context provides otherwise, different labels used for a feature (e.g., "first circuit," "second circuit," "particular circuit," "given circuit," etc.) refer to different instances of the feature. The labels "first," "second," and "third" when applied to a particular feature do not imply any type of ordering (e.g., spatial, temporal, logical, etc.), unless stated otherwise.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical). More specifically, this formulation is used to indicate that this structure is arranged to perform the one or more tasks during operation. A structure can be said to be "configured to" perform some task even if the structure is not currently being operated. Thus, an entity described or recited as "configured to" perform some task refers to something physical, such as a device, circuit, memory storing program instructions executable to implement the task, etc. This phrase is not used herein to refer to something intangible.

The term "configured to" is not intended to mean "configurable to." An unprogrammed FPGA, for example, would not be considered to be "configured to" perform some specific function. This unprogrammed FPGA may be "configurable to" perform that function, however.

Reciting in the appended claims that a structure is "configured to" perform one or more tasks is expressly intended not to invoke 35 U.S.C. § 112(f) for that claim element. Should Applicant wish to invoke Section 112(f) during prosecution, it will recite claim elements using the "means for" [performing a function] construct.

The phrase "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

The phrase "in response to" describes one or more factors that trigger an effect. This phrase does not foreclose the possibility that additional factors may affect or otherwise trigger the effect. That is, an effect may be solely in response to those factors, or may be in response to the specified factors as well as other, unspecified factors. Consider the phrase "perform A in response to B." This phrase specifies that B is a factor that triggers the performance of A. This phrase does not foreclose that performing A may also be in response to some other factor, such as C. This phrase is also intended to cover an embodiment in which A is performed solely in response to B.

Numerous variations and modifications will become apparent to those skilled in the art once the above disclosure is fully appreciated. It is intended that the following claims be interpreted to embrace all such variations and modifications.

What is claimed is:

1. An apparatus comprising:

a low dropout (LDO) voltage regulator, the LDO including a power transistor having a drain terminal coupled to an output voltage node, a gate terminal coupled to an error amplifier, and a source terminal coupled to an input voltage node; and a detection circuit having a first input coupled to the gate terminal and a second input coupled to the drain terminal, wherein the detection circuit is configured to assert an indication responsive to detecting that the LDO voltage regulator has entered operation below a minimum dropout.

2. The apparatus of claim 1, wherein the detection circuit is configured to detect that the LDO voltage regulator has entered operation below a minimum dropout based on a difference between a value of a first current and a value of a second current, wherein the first current is based on a difference between a voltage on the gate terminal and a voltage on the drain terminal, and wherein the second current is based on a threshold voltage of the power transistor.

3. The apparatus of claim 2, wherein the detection circuit includes a first low-pass filter coupled to the gate terminal of the power transistor and a second low-pass filter coupled to the drain terminal of the power transistor.

4. The apparatus of claim 3, wherein the detection circuit includes a transconductance circuit having a first input coupled to the first low-pass filter and a second input coupled to the second low-pass filter, wherein the transconductance circuit is configured to generate the first current.

5. The apparatus of claim 4, wherein the transconductance circuit includes:

a first input transistor having a gate terminal coupled to the first input;

a second input transistor having a gate terminal couped to the second input;

first and second resistors coupled between a ground node and the first and second input transistors, respectively;

a first current mirror coupled to the first and second input transistors; and a second current mirror coupled to the first current mirror, wherein the second current mirror is configured to generate the first current based on a current generated in the first current mirror.

6. The apparatus of claim 2, wherein the detection circuit includes a threshold sense circuit configured to generate the second current, wherein the threshold sense circuit includes a replica transistor having one or more device characteristics matched with corresponding characteristics of the power transistor.

7. The apparatus of claim 6, wherein the threshold sense circuit further includes:

a gain transistor having a gate terminal couped to a drain terminal of the replica transistor and a source terminal coupled to a gate terminal of the replica transistor;

a bias current source coupled between the drain terminal of the replica transistor and a ground node; and a current mirror coupled to a drain terminal of the gain transistor, wherein the current mirror includes a pair of matched transistors, and wherein the current mirror is configured to generate the second current.

8. The apparatus of claim 2, wherein the detection circuit further comprises a comparator circuit configured to compare the value of the first current to the value of the second current, wherein the comparator circuit is configured to assert the indication responsive to determining that the value of the first current is greater than the value of the second current.

9. The apparatus of claim 8, wherein the comparator circuit comprises a Schmitt trigger.

10. The apparatus of claim 1, wherein the detection circuit is coupled to provide the indication to a power management circuit, wherein the power management circuit is configured to begin a shutdown procedure to remove power from a load circuit coupled to the LDO voltage regulator responsive to receiving the indication.

11. A method comprising:

providing an output voltage from a low dropout (LDO) voltage regulator, wherein the LDO regulator includes a power transistor having a drain terminal coupled to an output voltage node, a gate terminal coupled to an error amplifier, and a source terminal coupled to an input voltage node;

detecting, using a detection circuit, that the LDO voltage regulator has entered operation below a minimum dropout, wherein the detecting comprises the detection circuit determining that the power transistor has entered operation in a linear region based on voltages present on the gate and drain terminals; and providing an indication responsive to detecting that the LDO voltage regulator has entered operation below the minimum dropout.

12. The method of claim 11, wherein detecting that the LDO voltage regulator has entered operation below the minimum dropout comprises:

generating a first current based on a difference between a voltage on the gate terminal and a voltage on the drain terminal; and generating a second current based on a threshold voltage of the power transistor.

13. The method of claim 12, wherein generating the first current comprises:

providing a low-pass filtered version of the voltage on the gate terminal to a first input of a transconductance circuit;

providing a low-pass filtered version of the voltage on the drain terminal to a second input of the transconductance circuit;

generating, using a first current mirror, a third current using the low-pass filtered versions of the voltages on the gate terminal and the drain terminal; and generating the first current based on the third current.

14. The method of claim 12, further comprising generating the second current using a threshold sense circuit having a replica transistor, wherein the replica transistor has one or more device characteristics matched with corresponding characteristics of the power transistor, and wherein generating the second current further comprises:

a gain transistor providing gain to a gate-drain voltage of the replica transistor; and a current mirror generating the second current based on the gain provided to the gate-drain voltage of the replica transistor.

15. The method of claim 12, further comprising:

comparing, using a comparator circuit, a value of the first current to a value of the second current; and generating the indication responsive to determining that the value of the first current is greater than value of the second current.

16. A system comprising:

a functional circuit block;

a low dropout (LDO) voltage regulator configured to provide a regulated supply voltage to the functional circuit block, wherein the low dropout regulator includes an error amplifier and a power transistor having a gate terminal coupled to an output of the error amplifier;

a detection circuit coupled to drain and gate terminals of the power transistor and configured to detect that the LDO voltage regulator has entered operation below a minimum dropout; and a power management circuit, wherein responsive to receiving an indication from the detection circuit that the LDO voltage regulator has entered operation below the minimum dropout, the power management circuit is configured to initiate a power down procedure for the functional circuit block.

17. The system of claim 16, wherein the detection circuit is configured to:

generate a first current based on a difference between a gate voltage of the power transistor and a drain voltage of the power transistor;

generate a second current based on a threshold voltage of the power transistor;

compare the first current to the second current; and assert the indication responsive to determining that a value of the first current is greater than a value of the second current.

18. The system of claim 17, wherein the detection circuit is further configured to:

provide a first voltage to a first input of a transconductance circuit, wherein the first voltage is a low-pass filtered version of the gate voltage;

provide a second voltage to a second input of the transconductance circuit, wherein the second voltage is a low-pass filtered version of the drain voltage; and generate the first current based on the first and second voltages.

19. The system of claim 18, wherein the transconductance circuit is configured to:

generate a third current in a first current mirror, wherein the third current is based on the difference between the gate voltage and the drain voltage; and generate the first current based on the third current.

20. The system of claim 17, wherein the detection circuit includes a threshold sense circuit configured to generate the second current, wherein the threshold sense circuit includes:

a replica transistor having one or more device characteristics matching corresponding characteristics of the power transistor;

a gain transistor configured to provide gain to a gate-drain voltage of the replica transistor; and a current mirror configured to generate the second current based on the gain provided to the gate-drain voltage of the replica transistor.

* * * * *